US008314673B2

(12) United States Patent
Scian et al.

(10) Patent No.: US 8,314,673 B2
(45) Date of Patent: Nov. 20, 2012

(54) TRANSFORMER ASSEMBLY

(75) Inventors: Ilario Scian, Cordenons (IT); Thomas Fogelberg, Ludvika (SE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/052,806

(22) Filed: Mar. 21, 2011

(65) Prior Publication Data

US 2011/0227684 A1 Sep. 22, 2011

Related U.S. Application Data

(63) Continuation of application No. PCT/EP2008/062569, filed on Sep. 19, 2008.

(51) Int. Cl.
*H01F 27/08* (2006.01)

(52) U.S. Cl. ..... 336/55

(58) Field of Classification Search ..... 336/55–62
See application file for complete search history.

(56) References Cited

U.S. PATENT DOCUMENTS

| | | | | |
|---|---|---|---|---|
| 3,629,758 | A | 12/1971 | Pearce, Jr. | |
| 3,701,929 | A | 10/1972 | Taguchi et al. | |
| 3,837,527 | A | 9/1974 | Kutik et al. | |
| 4,581,477 | A * | 4/1986 | Harumoto et al. | 174/15.1 |
| 4,904,972 | A | 2/1990 | Mori et al. | |
| 5,887,439 | A | 3/1999 | Kotliar | |
| 7,317,598 | B2 * | 1/2008 | Magnier | 361/37 |
| 2005/0095177 | A1 | 5/2005 | Golner et al. | |
| 2006/0012948 | A1 | 1/2006 | Norris et al. | |

FOREIGN PATENT DOCUMENTS

| | | | |
|---|---|---|---|
| EP | 0 447 389 | A2 | 9/1991 |
| GB | 2 355 857 | A | 5/2001 |
| JP | 56-135911 | A | 10/1981 |
| WO | WO 2008/043389 | A1 | 4/2008 |

OTHER PUBLICATIONS

International Search Report (PCT/ISA/210) issued on Dec. 22, 2008, by Japanese Patent Office as the International Searching Authority for International Application No. PCT/EP2008/062569.
Written Opinion (PCT/ISA/237) issued on Dec. 22, 2008, by Japanese Patent Office as the International Searching Authority for International Application No. PCT/EP2008/062569.
International Search Report (PCT/ISA/210) issued on Sep. 25, 2009, by Japanese Patent Office as the International Searching Authority for International Application No. PCT/EP2008/062571.
Written Opinion (PCT/ISA/237) issued on Sep. 25, 2009, by Japanese Patent Office as the International Searching Authority for International Application No. PCT/EP2008/062571.
International Search Report (PCT/ISA/210) issued on Jun. 18, 2009, by Japanese Patent Office as the International Searching Authority for International Application No. PCT/EP2008/063343.
Written Opinion (PCT/ISA/237) issued on Jun. 18, 2009, by Japanese Patent Office as the International Searching Authority for International Application No. PCT/EP2008/063343.

* cited by examiner

*Primary Examiner* — Tuyen Nguyen
(74) *Attorney, Agent, or Firm* — Buchanan Ingersoll & Rooney PC

(57) ABSTRACT

An exemplary transformer assembly as disclosed herein includes an electrical transformer having a transformer tank and a housing inside which the transformer tank is accommodated. The space between the transformer tank and the housing contains a gaseous atmosphere. The level of oxygen of the gaseous atmosphere inside the space is regulated below or equal to a first predefined threshold at a first status of the electrical transformer and equal to or above a second predefined threshold at a second status of the electrical transformer.

17 Claims, 5 Drawing Sheets

TRANSFORMER ASSEMBLY

RELATED APPLICATION

This application claims priority as a continuation application under 35 U.S.C. §120 to PCT/EP2008/062569 filed as an International Application on Sep. 19, 2008 designating the U.S., the entire content of which is hereby incorporated by reference in its entirety.

FIELD

The present disclosure relates to a transformer assembly, and to optimizing a structure and performance with regard to, for example, resistance to explosions and propagation of fires.

BACKGROUND INFORMATION

It is known in the art the use of electrical transformers, such as power transformers, for transmitting and distributing electricity through electrical grids.

A task of an electrical transformer is to allow exchanging electric energy between two or more electrical systems of different voltages by stepping up or down the level of voltage. According to a basic layout widely used in the art, a common power transformer includes a tank inside which there are positioned the active parts of the transformer itself, namely the magnetic core and a plurality of windings, which can be immersed in an insulating fluid, for instance a mineral oil.

Due to their intrinsic structure and functioning, during their working life electrical transformers may be subject to explosions and fires; these events can be triggered for example by electrical arcs and are fed by the energy flowing from the electrical grid into the transformer.

The effects of such explosions and fires can be very dangerous and may cause severe damages to the transformer and to the various equipment/loads operatively coupled therewith, disruption of the energy transportation even for long periods, thus resulting in economic losses for utilities/users.

Some solutions have been considered over the years in order to reduce such effects. For example, some electrical transformers have been provided with faster fault detection systems, or with improved protection fuses and circuit breakers. In some other cases explosion valves or sprinkler systems have been used, or different types of non-flammable insulating fluids have been investigated.

At the current state of the art, although the solutions adopted allow achieving improved results, it would be desirable to improve the capability of electrical transformers to face and withstand the occurrence of explosions and fires.

SUMMARY

A transformer assembly is disclosed comprising: an electrical transformer having a transformer tank; a housing inside which said transformer tank is accommodated, wherein the space between said transformer tank and said housing contains a gaseous atmosphere; and conditioning means adapted to regulate a level of oxygen of said gaseous atmosphere inside said space equal to or below a first predefined threshold at a first status of said electrical transformer, and equal to or above a second predefined threshold at a second status of said electrical transformer.

BRIEF DESCRIPTION OF THE DRAWINGS

Features, aspects, and advantages of the present disclosure will become better understood with regard to the following description, appended claims, and accompanying drawings where:

It should be noted that in order to clearly and concisely disclose the present invention, the drawings may not necessarily be to scale and certain features of the disclosure may be shown in somewhat schematic form.

DETAILED DESCRIPTION

An electrical transformer is disclosed which can provide improved countering of the occurrence of explosions and fires.

In exemplary embodiments, a transformer assembly includes an electrical transformer having a transformer tank; a housing inside which the transformer tank is accommodated, wherein the space between the transformer tank and the housing contains a gaseous atmosphere; and conditioning means adapted to regulate the level of oxygen of the gaseous atmosphere inside the space below or equal to a first predefined threshold at a first status of the electrical transformer and equal to or above a second predefined threshold at a second status of the electrical transformer.

Figure 1:
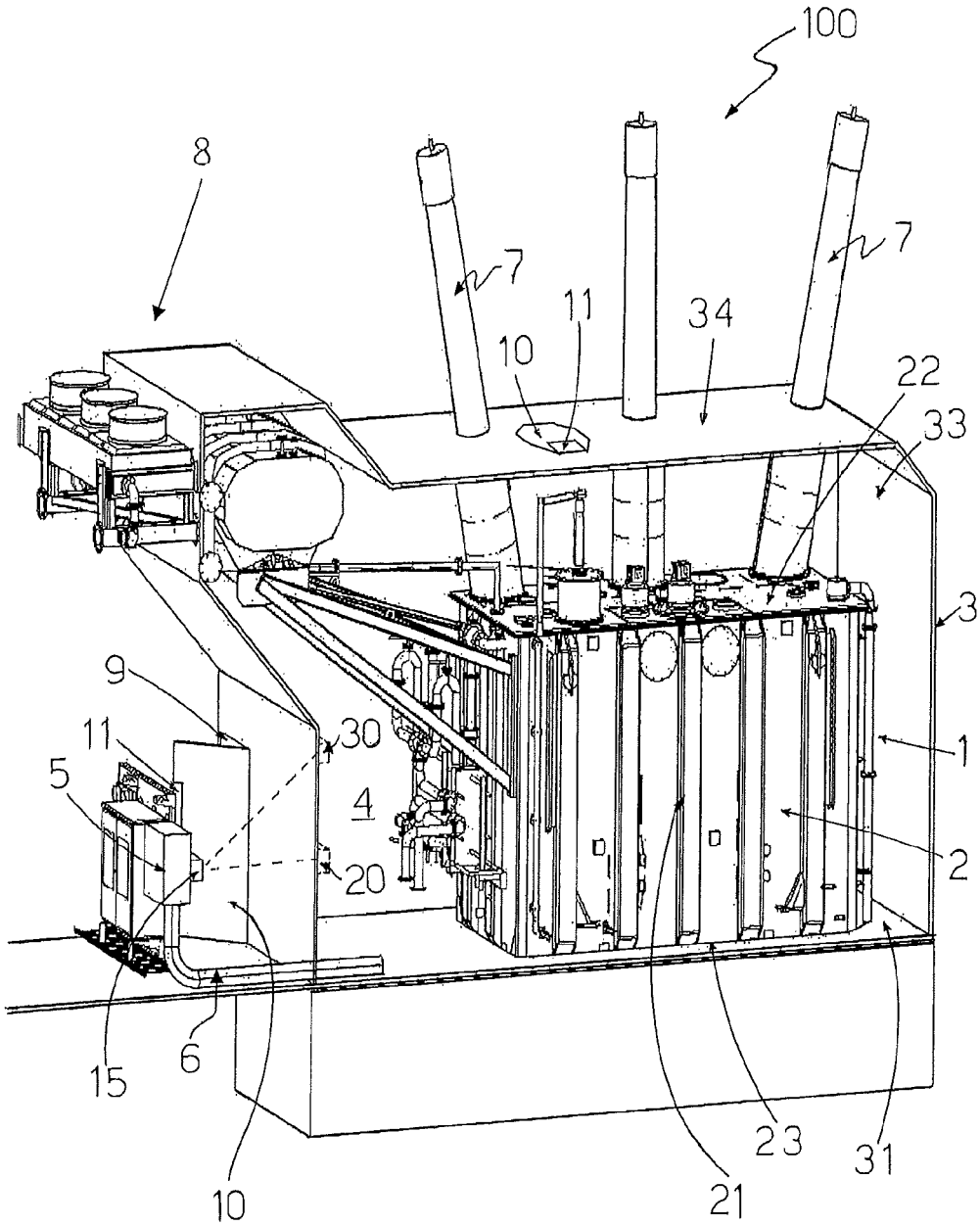
FIG. 1 is perspective view showing an example of a transformer assembly as disclosed herein.

FIG. 1 is a perspective view (partially cut in order to better illustrate some internal components) of an exemplary transformer assembly according to the disclosure indicated by the overall reference number 100.

As shown, the transformer assembly 100 comprises an electrical transformer 1, such as a power transformer, having a transformer tank 2. The tank 2 comprises a plurality of side walls 21, a top wall 22, a base wall 23, and contains, among the others, active parts of the transformer (i.e., the core and the windings, which are immersed into an insulating fluid, such as a mineral oil).

As it will be appreciated by those skilled in the art, the transformer 1 can be constituted by any suitable type of transformers available on the market; since the possible overall layouts of the transformer 1, the structure of its various components and their mutual coupling, as well as its functioning, are readily available and known in the art and do not have impact on understanding inventive aspects disclosed herein, they will not be described herein in further details.

The transformer assembly 100 can include a housing 3 having a base wall 31, a plurality of side walls 33, a top wall 34, and inside which the transformer tank 2 is accommodated. In practice, the housing 3 encapsulates the tank 2 with side walls 33 (or portion thereof) facing corresponding side walls 21; a free volume or space 4 is provided between the transformer tank 2 and the housing 3. The volume or space 4 contains a gaseous atmosphere constituted by a gas or mixture of gases. For example, when the transformer assembly 100 is initially installed and before conditioning, the gaseous atmosphere can be constituted by ambient air. Alternatively, the space 4 can be filled with any desired and suitable gas of mixtures of gases which may already comprise oxygen or not comprising oxygen at all. During the working life of the transformer assembly 100, oxygen can penetrate into the space 4 for any reason, for example when the housing 3 is open for performing maintenance.

Figure 2:
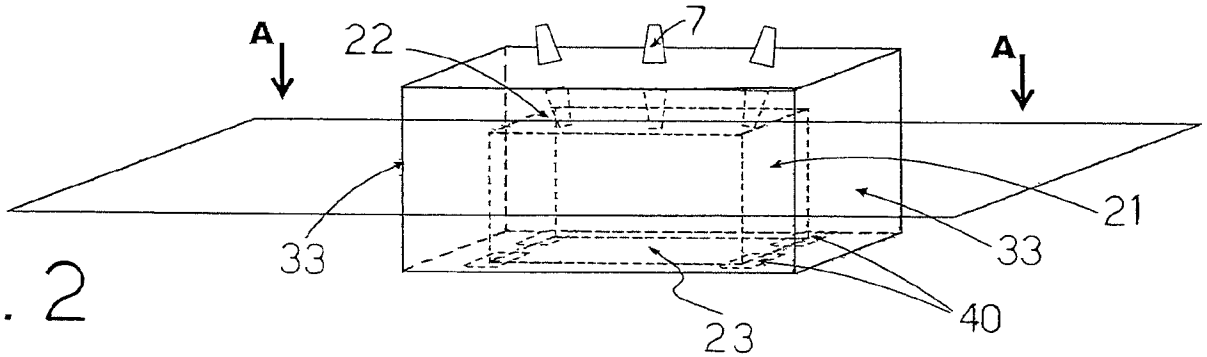
FIG. 2 is a schematic representation of an exemplary transformer tank positioned inside a housing usable in a transformer assembly.

In exemplary embodiments, inside the housing 3 there are provided noise dampening means, such as for instance rubber pads or equivalent means; at least some of the noise dampening means, indicated schematically in FIG. 2 by the reference number 40 can be positioned on the base wall 31 of the housing 3, with the tank 2 resting on them.

Bushings 7, or equivalent electrical connection means such as cables, can protrude out from the housing 3 in order to provide the transformer 1 with outside electrical connections.

Further there can be provided suitable cooling means 8 for properly cooling the transformer 1.

Figure 6:
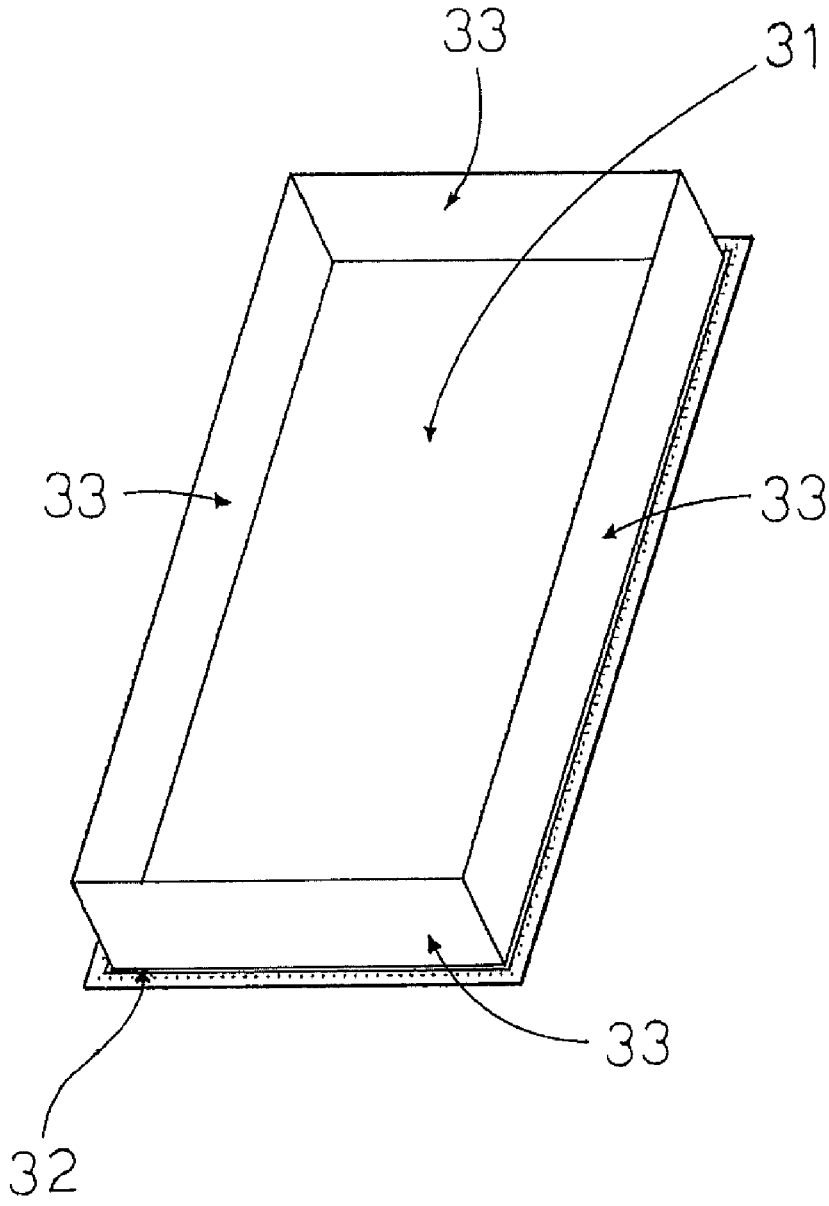
FIG. 6 schematically shows an exemplary partial structure of an external housing usable in the transformer assembly as disclosed herein.

The housing 3 can be structured so as to be substantially airtight. For example, as schematically illustrated in FIG. 6, the housing 3 can be formed by the base wall 31 on which the remaining structure of the housing (e.g., all side walls 33 and the top wall 34) are mounted. For example, the base wall 31 can be provided with a seat or groove inside which a sealing gasket 32 is placed; then the side walls 33 can be placed into the seat or groove onto the gasket 32. The top wall can be connected to the top part of the side walls 33 for example by soldering or by realizing a structure similar to that of the base wall 31 (e.g., providing the top wall 34 with a corresponding seat or groove inside which another gasket 32 is inserted).

The housing 3 can be an explosion-proof enclosure (e.g., an enclosure suitable to contain inside the space 4 explosions occurring on the transformer 1).

Figure 3:
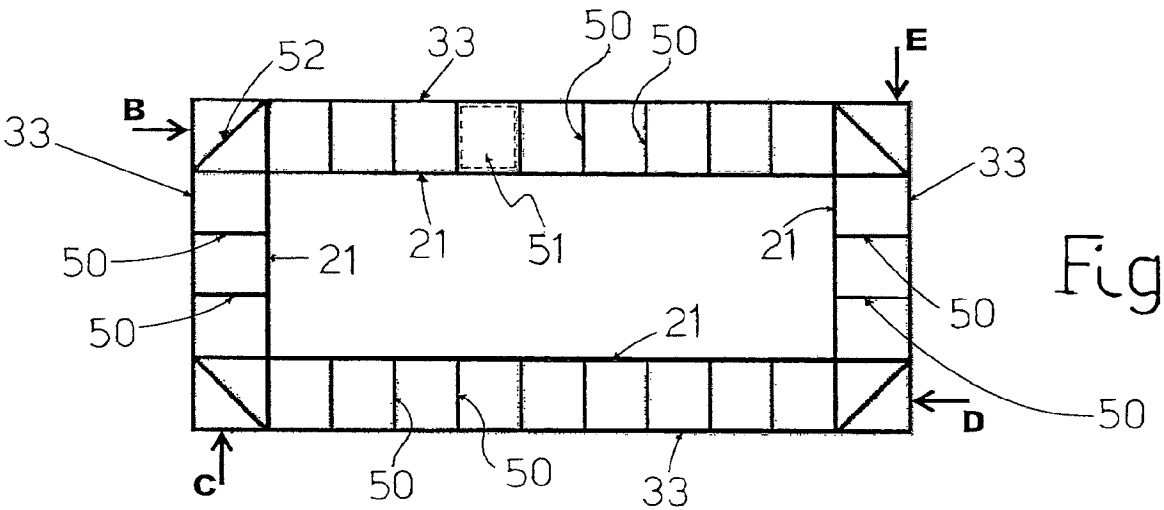
FIG. 3 is a cross-section along the plane A-A of FIG. 2 schematically showing an exemplary structure of the transformer tank associated to an external housing.
Figure 4:
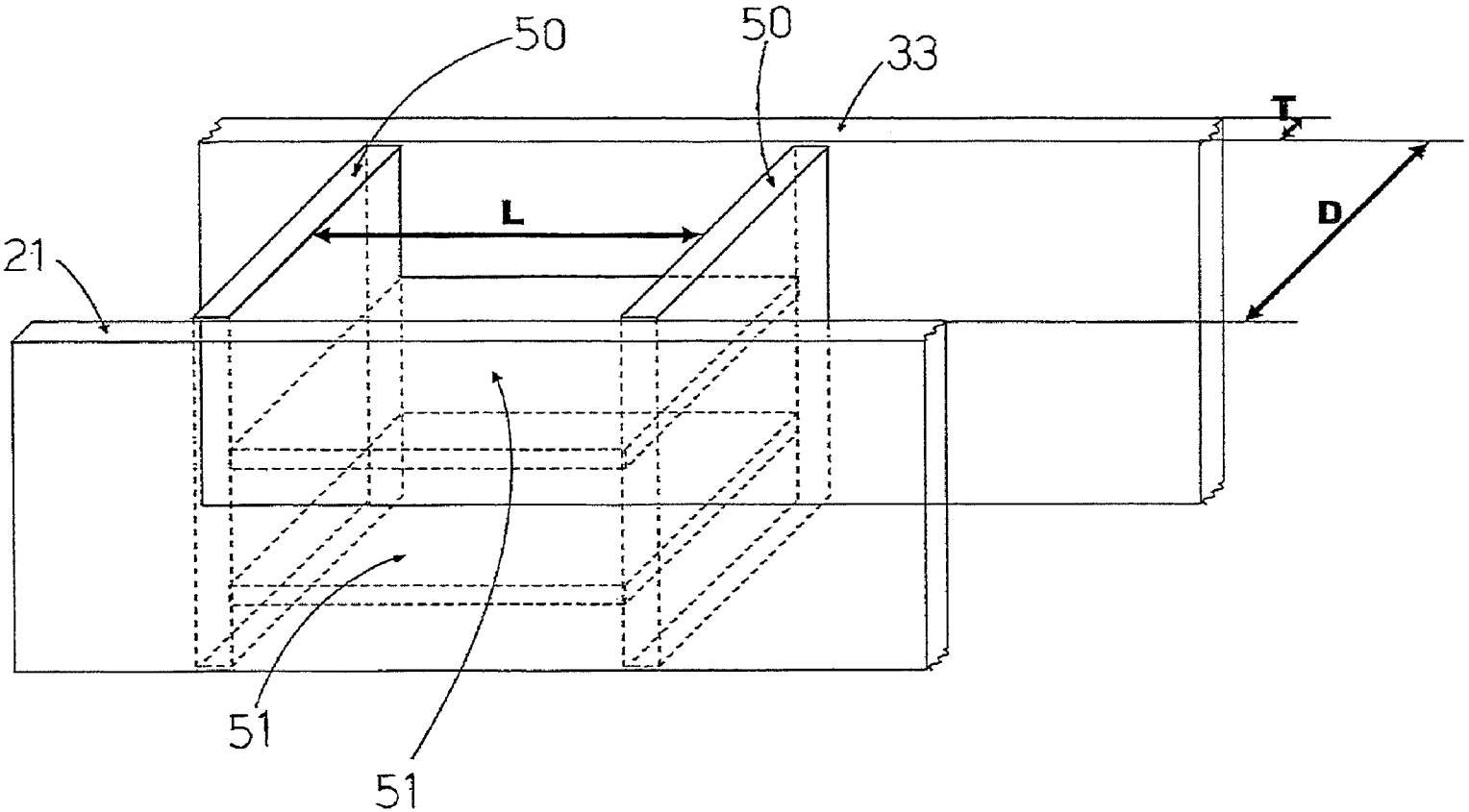
FIG. 4 is a perspective view showing an exemplary embodiment of part of the transformer assembly as disclosed herein.

According to an exemplary embodiment schematically illustrated in FIGS. 2-4, the housing 3 comprises at least one side wall 33 which has a minimum thickness (T) and is positioned at a minimum distance (D) from the corresponding side wall 21 facing it, wherein the ratio between its minimum thickness (T) and its minimum distance (D) from the corresponding facing wall 21 is comprised between 0.0001 and 100. For example, if the minimum distance (D) is 10 m, the minimum thickness of the subject side wall 33 is 1 mm.

According to exemplary applications, each side wall 33 (as well as the top and base walls) of the housing 3 may have a constant or variable thickness (T), and two or more side walls may have substantially the same thickness (T) or a thickness different from each other; further, each side wall 33 of the housing 3 can be positioned at the same distance (D) from a corresponding facing side wall 21 of the tank 2, as for instance illustrated in FIG. 3, or can be placed at different distances (D).

In any case, according to an exemplary embodiment, each side wall 33 of the housing 3 has a minimum thickness ($T_1$, $T_2$, . . . $T_n$) and is positioned at a minimum distance ($D_1$, $D_2$, . . . $D_n$) from the corresponding facing wall 21 of the tank 2, so as each ratio ($T_1/D_1$, $T_2/D_2$, . . . $T_n/D_n$) between the thickness ($T_i$) of a side wall 33 of the housing 3 and its distance ($D_i$) from the corresponding facing wall 21 of the tank 2 is between 0.0001 and 100.

According to an exemplary embodiment schematically illustrated in FIGS. 2-4, the transformer assembly can comprise a plurality of reinforcing walls 50. Each reinforcing wall 50 can be positioned between a side wall 33 of the housing 3 and a corresponding facing side wall 21 of the tank 2.

The reinforcing walls 50 can have for example a rectilinear profile and can be positioned parallel to each other along a side of the transformer assembly (sides indicated by capital letter B, C, D, E in FIG. 3).

In any case, according to an exemplary embodiment, two adjacent reinforcing walls 50 which are positioned along the same side (B, or C, or D, or E) of the transformer assembly 100, are spaced apart from each other of a minimum distance (L); this distance (L) is for example shorter than the minimum distance (D) between the side wall 33 and the corresponding facing wall 21 between which the couple of adjacent reinforcing walls 50 is positioned.

Further, as schematically illustrated in FIG. 4, in each volume or area 60 delimited by two adjacent reinforcing walls 50, by the associated side wall 33 and the respective facing wall 21, there could be positioned one or more transversal reinforcing walls 51. The transversal reinforcing walls 51 can be positioned spaced apart from each other along the vertical extension of the surrounding walls 21, 33, 50 and can be connected to one or more of them.

If desired, some additional reinforcing walls 52 can be positioned diagonally at the corners of the transformer assembly 100 as schematically illustrated in FIG. 3.

The transformer assembly 100 can comprise conditioning means adapted to regulate the level or content of oxygen of the gaseous atmosphere inside the space 4.

For example, the conditioning means can be configured so as to maintain the level of oxygen of the atmosphere inside the space 4 below or equal to a first predefined threshold at a first status of the electrical transformer 1 (e.g., under normal working conditions), and equal to or above a second predefined threshold at a second status of the electrical transformer 1, for example in order to allow personnel entering inside the housing 3 and performing maintenance.

The first threshold and the second threshold of oxygen level can be selected according to applications and/or standards defined internationally or at country levels. Such first and second thresholds can even coincide but they can also be different from each other; for example, in the transformer assembly according to the disclosure, the first threshold is for example about 16% (or even lower, ±10%) of oxygen content of the total volume of gaseous atmosphere inside the space 4, while the second threshold of oxygen content is about 17% of the total volume of gaseous atmosphere inside the space 4.

The conditioning means can comprise a device adapted to introduce into the space 4 a gas or mixtures of gases comprising a predetermined quantity of oxygen; according to the disclosure, the predetermined quantity of oxygen can be also equal to zero.

According to a first exemplary embodiment, the conditioning means can comprise a first device adapted to introduce into the space 4 a gas or mixtures of gases comprising a quantity of oxygen lower than that of ambient air (even equal to zero), and a second device adapted to introduce into the space 4 a gas or mixtures of gases having a quantity of oxygen equal to or higher than that of ambient air. Reference is hereby made to the average composition of ambient air at sea level.

Alternatively, the conditioning means can comprise a unique device configured to introduce into the space 4 a gas or mixtures of gases having a quantity of oxygen lower than that of ambient air at the first status, or a gas or mixtures of gases having a quantity of oxygen equal to or higher than that of ambient air at the second status.

The conditioning device/devices can be constituted by one or more suitable storage units containing a mixture of gases or a substantially pure gas, with the predetermined content of oxygen. For example, it is possible to use a cylinder or bottle (optionally associated to a compressor) which contains nitrogen and is properly coupled to the housing 3 in order to introduce into the space 4 the needed quantity of gas contained therein thus bringing the level of oxygen inside the space 4 equal to or below the first threshold.

The same applies for example when using one or more storage units containing only oxygen or a mixture of gases with a content of oxygen higher than that of ambient air.

The conditioning means can, for example, comprise also a sensor for detecting/monitoring oxygen inside the space 4, schematically indicated in FIG. 1 by the reference number 20. A control unit 15, which is embedded into or coupled to the above indicated device/devices, based on the information received from the oxygen sensor, checks if the level of oxygen in the space 4 is compatible with the actual status of the transformer. If this is not the case, the control unit 15 triggers an increase or reduction of the level of oxygen inside the space 4 by causing intervention of the above indicated device/devices.

As it will be appreciated by those skilled in the art, the construction and functioning of the control unit 15 are readily and easily implemented in any known manner, without further inventive activity and therefore will not be described herein in detail. The control unit 15 can comprise for example a microprocessor.

The conditioning means can comprise also a pressure sensor, schematically indicated in FIG. 1 by the reference number 30 which is also operatively coupled to the control unit 15. Signals from the pressure sensor 30 are received by the control unit 15 thus allowing to measure and monitor the pressure of the gaseous atmosphere contained inside the space 4. If such a pressure is above or below a predefined selectable threshold, the control unit 15 stops or activates the above indicated conditioning device/devices.

Figure 5:
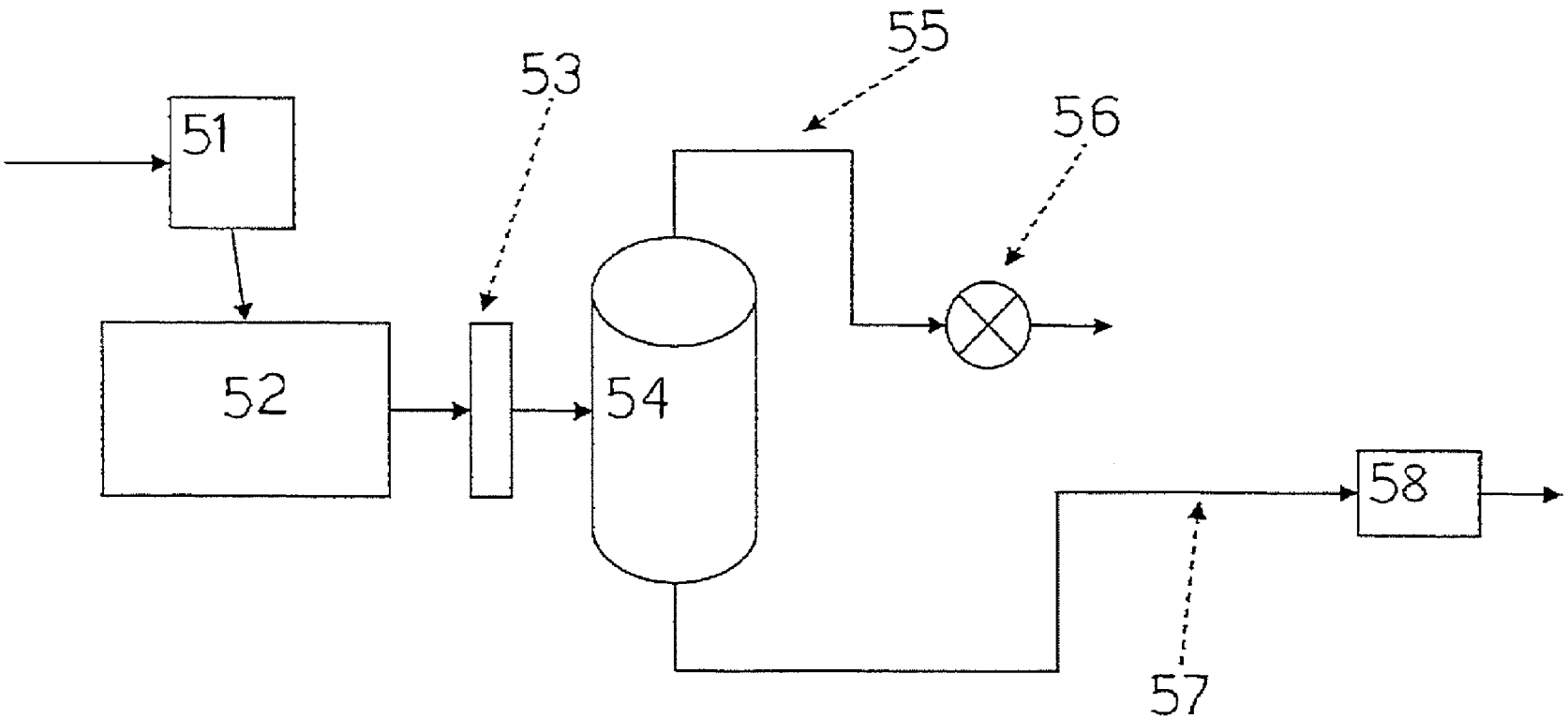
FIG. 5 is a block diagram schematically illustrating an exemplary embodiment of conditioning means usable in the transformer assembly as disclosed herein.

FIGS. 1 and 5 schematically illustrate an exemplary embodiment for the conditioning means. According to this embodiment, the conditioning means comprises a generator 5 of a gas or mixtures of gases comprising a level of oxygen lower than that of ambient air, namely a nitrogen or hypoxic-air or depleted-oxygen-air generator.

The generator 5 can be attached directly onto one of the walls of the housing 3 or positioned at a certain distance there from. Conduits 6 or equivalent means can be used for circulating the gas or mixture of gases generated inside the space 4.

As shown in the schematic block diagram of FIG. 5, the generator 5 comprises an inlet 51 sucking ambient air and provided with a dust filter in order to clean up the sucked quantity of air. The airflow is then compressed by a compressor 52 and passes through a cooler 53 which cools the hot compressed air coming out from the compressor 52. The air is then treated inside a module 54 adapted to separate gases. In practice, the module 54 allows separating gases composing the air under treatment, and in particular to separate oxygen from the other gases, basically nitrogen.

The module 54 can comprise for example a chamber with an assembly of valves and molecular sieve beds for separating gases, and in particular absorbing oxygen (PSA—Pressure Swing Absorption—module). Alternatively, a chamber with suitable membranes can be used.

Therefore, in output from the module 54 there is a first flow 55 of oxygen enriched air and a second flow 57 of hypoxic air (or in equivalent terms hyper nitrogen air). When needed, the second flow 57 is introduced into the space 4 by means of the conduits 6, directly or after passing through an optional filter 58 (e.g., a high efficiency particulate air filter), for further cleaning up the hypoxic air.

In turn, the first flow 55 of oxygen enriched air can be relaxed into the ambient air directly or after passing an optional adjustable or fixed flow regulator 56.

Examples of suitable devices of the type above described are those marketed by Rich International Trade Co. Ltd under the model name BGPN, or by Parke Hannifin Corporation under the product name Nitroflow.

According to this exemplary embodiment, the conditioning means adapted to introduce into the space 4 a gas or mixtures of gases having a quantity of oxygen equal to or higher than that of ambient air can comprise at least one opening 9 located on the housing 3 which is provided with a panel 10. The panel 10 can be moveable between a first closed position at the first status of the electrical transformer 1 and a second open position at the second status of the electrical transformer 1.

For example, as schematically shown in FIG. 1, the panel 10 can be constituted by an airtight door 10 suitable to close an opening 9 devised to allow access of personnel inside the housing 3.

Alternatively or in addition to the door 10, the moveable panel can be constituted by an airtight manhole 10 which is associated to an opening 9 positioned on one of the walls of the housing 3 (e.g., on the top wall 34).

The moveable panel 10, be it the airtight door and/or the airtight manhole, can for example be provided with a protection device 11, such as a simple mechanical interlock, for preventing people accessing the space 4 at least until the level of oxygen inside the space 4 is below the second threshold, and for example until when the atmosphere inside the space 4 has reached a minimum human breathable level.

Optionally, there may also be provided one or more fans adapted to force the ambient air from outside the housing 3 to inside the space 4 at the second operating status of the transformer 1, for example through any opening 9. These fans could be used also for forcing the hypoxic air outside the housing 3.

If desired, the generator 5 above described can be used, alternatively or in addition to the opening(s) 9-panel(s) 10, to introduce into the space 4 a gas or mixtures of gases having a quantity of oxygen higher than that of ambient air. In this case it would be possible to introduce into the space 4 the first flow 55 of enriched oxygen air (e.g., through the conduits 6).

In practice, it has been found that the transformer assembly according to the disclosure fully achieves the intended aim giving some advantages and improvements with respect to known solutions. In fact, when the transformer 1 is under normal working conditions, the gaseous atmosphere inside the space 4 is checked and if desired regulated so as the content of oxygen is kept below or equal to the first threshold thus resulting in a substantially fire-inert gas atmosphere (e.g., an atmosphere suitable to prevent ignition of fires, or at least able to prevent or fast suppress their propagation). In addition, if there is an explosive event occurring into the transformer 1, the housing 3 can contain such an explosion.

When it is desired for personnel to enter the space 4 inside the housing 3, the conditioning means previously described can allow increasing the level of oxygen equal to or better above the second indicated threshold, and realizing a breathable environment inside the housing 3.

The transformer assembly thus disclosed is susceptible of numerous modifications and variations, all of which are within the scope of the inventive concept as defined in the claims. All the details may furthermore be replaced with other technically equivalent elements, and the materials and dimensions may be any according to specification and to the state of the art, provided they are compatible with the scope of and functioning in the subject application.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A transformer assembly comprising:

an electrical transformer having a transformer tank;

a housing inside which said transformer tank is accommodated, wherein the space between said transformer tank and said housing contains a gaseous atmosphere; and conditioning means adapted to regulate a level of oxygen of said gaseous atmosphere inside said space equal to or below a first predefined threshold at a first status of said electrical transformer, and equal to or above a second predefined threshold at a second status of said electrical transformer.

2. The transformer assembly according to claim 1, wherein said conditioning means comprise:

a device adapted to introduce into said space a gas or mixtures of gases having a desired quantity of oxygen.

3. The transformer assembly according to claim 2, wherein said conditioning means comprise:

a device adapted to introduce into said space a gas or mixtures of gases having a quantity of oxygen lower than that of ambient air.

4. The transformer assembly according to claim 2, wherein said conditioning means comprise:

a device adapted to introduce into said space a gas or mixtures of gases having a quantity of oxygen equal to or higher than that of ambient air.

5. The transformer assembly according to claim 2, wherein said device comprises:

a hypoxic air generator.

6. The transformer assembly according to claim 1, wherein said conditioning means comprise:

a sensor for detecting oxygen inside said space.

7. The transformer assembly according to claim 1, wherein said conditioning means comprise:

a pressure sensor for monitoring pressure of the gaseous atmosphere contained inside said space.

8. The transformer assembly according to claim 1, wherein said conditioning means comprise:

at least one opening located on said housing, said opening being provided with a panel moveable between a first closed position at said first status of the electrical transformer and a second open position at said second status of the electrical transformer.

9. The transformer assembly according to claim 8, wherein said panel is provided with a protection device for preventing movement of the panel from said second closed position to said first open position until the level of oxygen inside said space is below said second predefined threshold.

10. The transformer assembly according to claim 1, wherein said housing comprises:

at least one side wall having a minimum thickness (T) and positioned at a minimum distance (D) from a corresponding facing side wall of the tank, wherein a ratio between said minimum thickness (T) and said minimum distance (D) is between 0.0001 and 100.

11. The transformer assembly according to claim 10, wherein said housing comprises:

a plurality of side walls, wherein each side wall of said plurality of side walls has a respective minimum thickness ($T_1$, $T_2$, . . . $T_n$) and is positioned at a respective minimum distance ($D_1$, $D_2$, . . . $D_n$) from a corresponding facing wall of said tank, wherein each ratio ($T_1/D_1$, $T_2/D_2$, . . . $T_n/D_n$) between each respective minimum thickness ($T_i$ of a side wall of said housing and a respective minimum distance ($D_i$) from the corresponding facing wall of the tank is between 0.0001 and 100.

12. The transformer assembly according to claim 10, comprising:

a plurality of reinforcing walls, each of which is positioned between a side wall of the housing and the corresponding facing side wall of the tank.

13. The transformer assembly according to claim 12, comprising:

a plurality of transverse reinforcing walls, each of which is positioned in the space delimited by a side wall of the housing, the corresponding facing side wall of the tank and two adjacent reinforcing walls positioned therebetween.

14. The transformer assembly according to claim 12, wherein two adjacent reinforcing walls are spaced apart from each other by a minimum distance (L) which is shorter than the distance (D) between a side wall of the housing and the corresponding facing side wall of the tank between which said two adjacent reinforcing walls are positioned.

15. The transformer assembly according to claim 1, wherein said housing is substantially airtight.

16. The transformer assembly according to claim 1, wherein said housing is an explosion-proof enclosure.

17. The transformer assembly according to claim 1, comprising:

noise dampening means which are positioned on a base wall of said housing, said tank resting on said noise dampening means.

* * * * *